US006142245A

United States Patent [19]

Best

[11] Patent Number: 6,142,245

[45] Date of Patent: Nov. 7, 2000

[54] EXTENDED REACH DRILLING SYSTEM

[75] Inventor: Bruno Best, Rijswijk, Netherlands

[73] Assignee: Shell Oil Company, Houston, Tex.

[21] Appl. No.: 09/129,283

[22] Filed: Aug. 5, 1998

[30] Foreign Application Priority Data

Aug. 19, 1997 [EP] European Pat. Off. ..... 97306275

[51] Int. Cl.[7] ..... E21B 7/00

[52] U.S. Cl. ..... 175/57; 175/98

[58] Field of Search ..... 175/51, 98, 99, 175/230, 321, 57; 299/31

[56] References Cited

U.S. PATENT DOCUMENTS

| | | | |
|---|---|---|---|
| 2,662,735 | 12/1953 | Arutunoff | 175/98 |
| 2,999,572 | 9/1961 | Hinckley | 175/98 |
| 3,023,821 | 3/1962 | Etherington | 175/230 |
| 3,138,214 | 6/1964 | Bridwell | 175/230 |
| 3,298,449 | 1/1967 | Bachman et al. | 175/230 |
| 3,799,277 | 3/1974 | Kellner | 175/99 |
| 3,827,512 | 8/1974 | Edmond | 175/99 |
| 4,060,141 | 11/1977 | Catterfeld | 175/94 |
| 4,095,655 | 6/1978 | Still | 175/19 |
| 4,281,723 | 8/1981 | Edmond et al. | 175/76 |
| 4,431,068 | 2/1984 | Dellinger et al. | 175/61 |
| 5,186,264 | 2/1993 | Du Chaffaut | 175/99 |
| 5,205,365 | 4/1993 | Quintana | 175/97 |
| 5,533,573 | 7/1996 | Jordan, Jr. et al. | 166/313 |
| 5,762,149 | 6/1998 | Donovan et al. | 166/313 |
| 5,794,703 | 8/1998 | Newman et al. | 175/99 |
| 5,923,170 | 7/1999 | Kuckes | 175/45 |
| 6,003,606 | 12/1999 | Moore et al. | 175/99 |

FOREIGN PATENT DOCUMENTS

| | | |
|---|---|---|
| 0 257 744 A2 | 3/1988 | European Pat. Off. . |
| 0 774 563 A2 | 5/1997 | European Pat. Off. . |
| 2 307 495 | 5/1997 | United Kingdom . |
| 89/05391 | 6/1989 | WIPO . |
| 93/10326 | 5/1993 | WIPO . |
| 94/27022 | 11/1994 | WIPO . |

*Primary Examiner*—Thomas B. Will
*Assistant Examiner*—Kristine M. Markovich

[57] ABSTRACT

An extended reach drilling (ERD) system for drilling a borehole in an underground formation is provided. The ERD system comprises a drill bit, a motor for driving the drill bit, a drill-pipe to surface, a hydraulic cylinder/piston arrangement for providing the required weight on bit, the drill-pipe being coupled to a selected one of the cylinder and the piston of the cylinder/piston arrangement such that the drill pipe may rotate relative to the selected one of the cylinder and the piston, the drill bit being coupled to the other one of the cylinder and the piston, and locking members for locking the selected one of the cylinder and the piston against the borehole wall, the locking members being operable between an engaged position and a disengaged position.

12 Claims, 2 Drawing Sheets

EXTENDED REACH DRILLING SYSTEM

FIELD OF THE INVENTION

The present invention relates to an extended reach drilling ("ERD") system to drill a bore hole in an underground formation.

BACKGROUND OF THE INVENTION

Wellbores which are drilled in the earth formation for hydrocarbon exploration and production purposes become ever deeper and more complex in geometry as many times curved, inclined or horizontal sections are included. Such deep and complex wellbores impose stringent requirements on the drill strings used.

So far the only proven successful method of drilling ERD wells is by continuous drill string rotation. However with increasing reach the build up of large friction forces between the drill string and the wellbore wall often hamper adequate wellbore operations.

Beyond a certain reach, drilling in the sliding mode, required for bit steering, becomes even impossible. Because of this, rotary steerable drilling systems are currently being developed. Owing to the high inclination of ERD wells, these systems require long and heavy bottom hole assemblies ("BHAs") comprising drill collars and heavy weight drill pipe sections to get the required weight on bit for efficient drilling.

This all adds to the surface torque for string rotation and results in heavy drill string designs finally reaching the mechanical limits of currently available equipment at around 10 km of reach. Pulling the drill string out of hole ("POOH") virtually becomes impossible in these wells mainly because of string yield. The present invention provides an ERD system which makes it possible to break through the 10 km limit.

SUMMARY OF THE INVENTION

The present invention therefore relates to an improved ERD system to drill a borehole in an underground formation, comprising:

a) a drill bit, b) a motor for driving the drill bit, c) a drill-pipe to surface, d) a hydraulic cylinder/piston arrangement for providing the required weight on bit ("WOB"), the drill-pipe being coupled to a selected one of the cylinder and the piston of said cylinder/piston arrangement by swivel means allowing rotation of the drill pipe relative to said selected one of the cylinder and the piston, the drill bit being coupled to the other one of the cylinder and the piston, and e) locking means for locking said selected one of the cylinder and the piston against the borehole wall, the locking means being operable between an engaged position and a disengaged position.

BRIEF DESCRIPTION OF THE DRAWINGS

FIG. I shows a schematic view of a preferred embodiment of the present ERD system.

FIG. II shows a typical situation during drilling of a deviated bore hole using the ERD system according to FIG. I.

Figure 1:
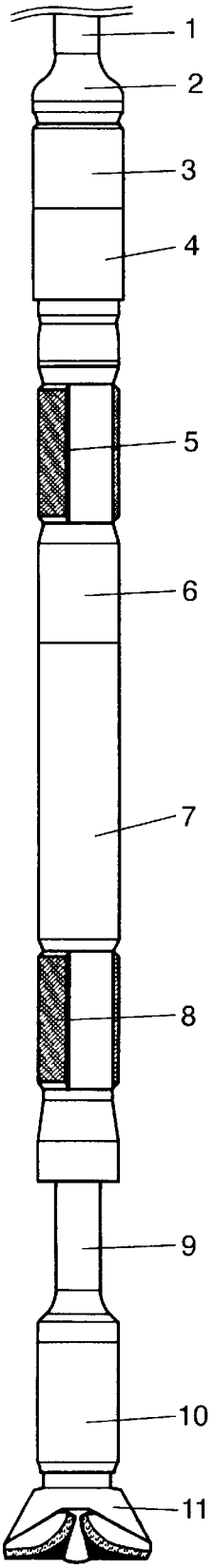
Figure 2:
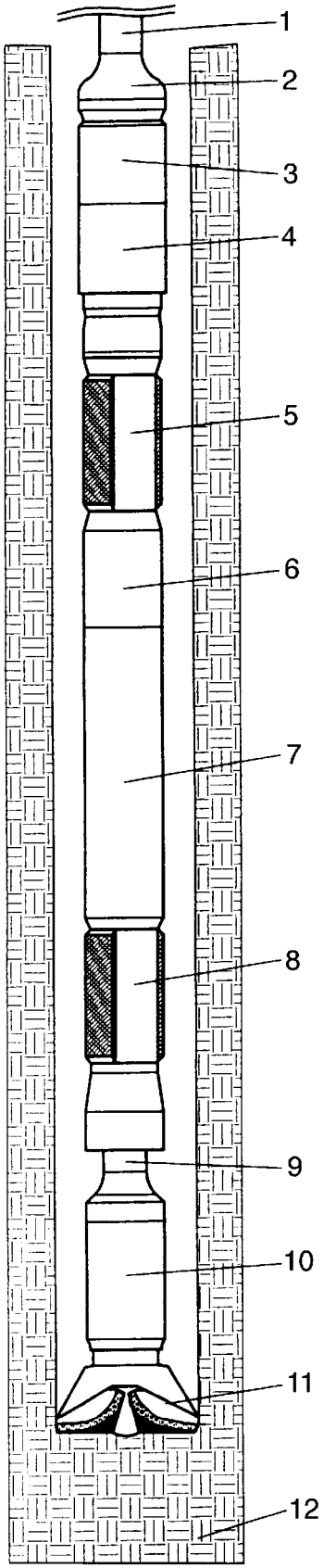
Figure 3:
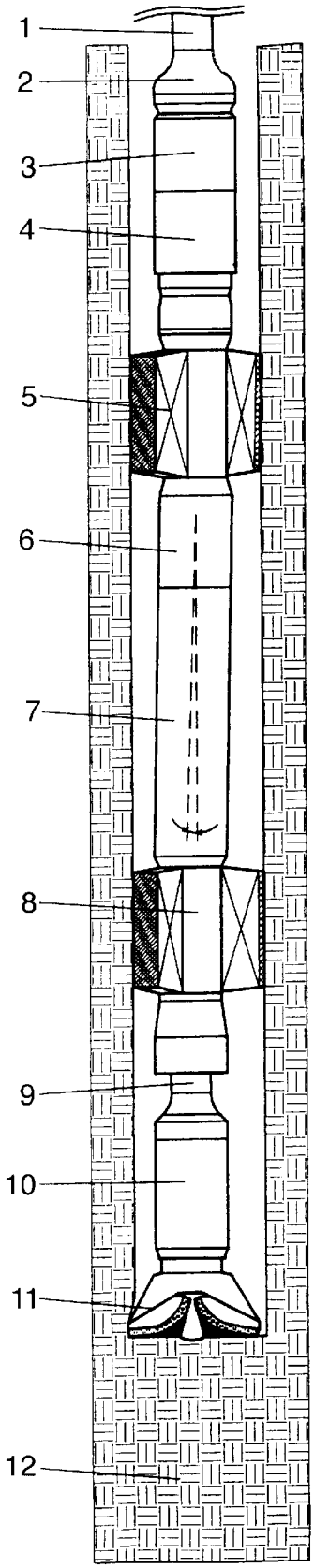
Figure 4:
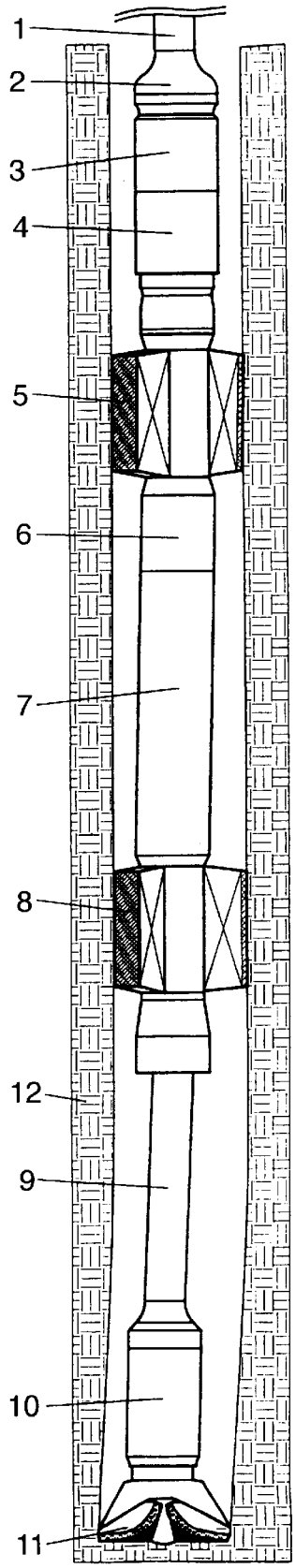

FIG. III shows another typical situation during drilling of a deviated bore hole using the ERD system according to FIG. I.

FIG. IV shows a third typical situation during drilling of a deviated bore hole using the ERD system according to FIG. I.

DETAILED DESCRIPTION

By operating the cylinder/piston arrangement to provide the required WOB while the motor drives the drill bit, the need for a heavy bottom hole assembly is obviated. The reaction force necessary to provide the required weight on bit is provided by the locking means being engaged against the borehole wall. Furthermore, the swivel means allows continuous rotation of the drill-pipe during drilling in order to reduce friction forces between the drill-pipe and the borehole wall, which friction forces could otherwise cause the drilling system becoming stuck in the borehole. After having drilled a full stroke of the cylinder/piston arrangement, the piston is retracted in the cylinder, the locking means is disengaged, and the ERD system is moved one stroke-length deeper into the borehole. Thereafter the locking means is re-engaged and drilling proceeds over another stroke-length of the piston/cylinder arrangement.

Preferably the swivel means comprises a downhole clutch which is operable between a disengaged position in which rotation of the drill-pipe relative to said selected one of the cylinder and the piston is allowed, and an engaged position in which such relative rotation is prevented. The clutch is operated in the disengaged position during drilling to allow rotation of the drill-pipe, and in the engaged position during movement of the ERD system deeper into the borehole.

Preferably said selected one of the cylinder and piston is the cylinder, and said other one of the cylinder and piston is the piston.

Adequate locking is suitably achieved if said locking means comprises at least two sets of radially extendible locking members, the sets including a front set of locking members being provided at a front part (at the bit side) of the cylinder and a rear set of locking members being provided at a rear part (at the drill-pipe side) of the cylinder.

To allow full steering of the ERD system with respect to both azimuth and inclination, it is preferred that at least one of the front set and the rear set of locking members is capable of positioning the cylinder concentric or eccentric in the borehole.

Suitably the front set of locking members is capable of positioning said front part of the cylinder concentric or eccentric in the borehole, and the rear set of locking members is capable of positioning said rear part of the cylinder concentric or eccentric in the borehole. By setting the locking members so that the cylinder is fully concentrically arranged in the borehole, a straight borehole section can be drilled. Conversely, by orienting the cylinder tilted in the borehole, a curved borehole section can be drilled. Such tilted orientation can be achieved, for example, by setting the front part of the cylinder eccentric and the rear part concentric, or vice versa. Higher tilt angles can be achieved by setting the front part and the rear part eccentric in opposite radial directions.

One way of actuating the cylinder/piston arrangement and the locking members is by using the drilling mud as a power source. Such actuation would require an increased flowrate and/or pressure of the drilling mud in order to maintain the necessary power for the drilling action of the drill bit. In view thereof, it is preferred that the ERD system further comprises a hydraulic pump for providing the power to operate the hydraulic cylinder/piston arrangement for the drilling action and each locking member for the wall locking action, the hydraulic pump being driven by the rotating drill-pipe. Only a low level of torque, required for the hydraulic power generation, is applied by the drill pipe to the hydraulic cylinder. The aforementioned downhole clutch is dis-engaged when the drill-pipe drives the hydraulic pump.

In the basic version of the ERD system according to the invention, the bit is rotated by a mud-motor and the required weight on bit is provided by the hydraulic cylinder/piston arrangement with an axial stroke of at least one meter, preferably 1–5 meters. No rotation of the axial piston relative to the cylinder is possible.

Furthermore the cylinder has at least two sets of locking members formed by hydraulically actuated radial pistons. One set of at least three pistons at the front, the bit side, and one set of at least three pistons at the rear, the drill-pipe side. By actuating these pistons, the tool locks itself against the bore hole wall, preferably by means of grippers attached to the pistons.

Once locked, the reactive bit torque and the WOB force can be taken. The rear set(s) of radial pistons will centralise its side of the tool in the bore hole or place it in an eccentric position. The front set(s) of radial pistons are capable of positioning this side of the tool eccentric or concentric with respect to the hole axis.

If the rear side of the tool is placed in a concentric position vis-a-vis the borehole axis and the front side of the tool is placed in an eccentric position with regard to the bore hole axis, the bit will be in a mis-aligned position with respect to the hole axis. This will also be the case if the situation is reversed, i.e. the rear side and the front side being in the eccentric and the concentric position, respectively. In this mis-aligned position the bit will be forced by the axial piston during its forward travel to drill in a deviated way.

In an advanced version of the ERD system according to the invention the mud motor is replaced by a hydraulic motor being driven by the oil from the hydraulic pump. Like in the basic version, in the advanced version the downhole clutch in its disengaged position allows continuous drill pipe rotation to drive the hydraulic oil pump. This pump provides the power to actuate the axial piston for the drilling action, the radial pistons for the wall locking action, as well as the hydraulic power to operate the motor driving the drill bit. In this case the drill-pipe will be subjected to additional torque, required for the hydraulic power generation to drive the bit.

Two methods of bit steering are advantageously applied: The surface controlled method and the automatic method. In the former method directional measurements from inclinometers and magnetometers, comprised by the ERD system, are sent to the surface via telemetry. Directional control is applied by sending coded mud-pulses from the surface to the tool. Based on these data the cylinder mis-alignment and thus the side-force and its direction on the bit are adjusted accordingly.

In the latter method the ERD system preferably comprises a memory. A preprogrammed well path is entered in the memory located in the tool.

Measurements from inclinometers and magnetometers combined with measurements of the stroke of the axial piston are compared to the pre-programmed well path data. If deviations from the programmed well path are detected, the tool will automatically make the required directional corrections, required to follow the pre-programmed well path by adequate mis-alignment of the hydraulic cylinder. The operation of the present ERD system will now be described with reference to the attached drawings. In all the Figures the enumerated parts have the following meanings:

1: Drill-pipe

2: Cross-over

3: Clutch

4: Pump for hydraulics

5: Lateral grippers, operated by concentric pistons (not shown)

6: Electronics for measurement while drilling and mud pulsing.

7: Hydraulic axial displacement system (cylinder)

8: Lateral grippers, operated by eccentric pistons (not shown)

9: Hydraulic axial displacement system (piston)

10: Mud motor (in the case of the basic system) or Hydraulic oil motor (in the case of the advanced system)

11: Bit

12: Underground.

A method of starting a drilling stroke, using the present ERD system, is preferably carried out as follows:

a) mud is circulated at a reduced rate, the radial pistons with their grippers (5,8) and axial pistons (9) being in their retracted position and the drill pipe (1) rotating with the downhole clutch (3) in engaged position;

b) full rate mud circulation is started, triggering the downhole electronics (6) to start the drilling process as follows:

c) the downhole clutch (3) is disengaged;

d) the radial pistons with their grippers (5,8) are actuated, locking the cylinder (7) in a programmed position in the hole to achieve the desired degree of deviated drilling;

e) the axial piston (9) is actuated by which the drilling process is started.

After the drilling stroke has been continued for sometime it is preferably ended as follows:

a) the axial piston (9) is retracted;

b) all radial pistons and grippers (5,8) are retracted;

c) the clutch (3) is engaged so that the whole system is rotating;

d) a pressure pulse is sent to the surface to trigger the surface process;

e) the rotating string (1) is lowered by a top-drive according to the piston stroke;

f) mud circulation is reduced as a signal for the downhole electronics (6) to monitor for full circulation to start the next drilling stroke.

When making a connection, i.e. mud is not circulated and the string is not rotated, all pistons (5,8,9) are retracted or kept retracted and the clutch (3) is engaged. Mud is started to circulate at a reduced rate and the rotating string is lowered over the remaining stroke. The reduced mud circulation signals to the downhole electronics (6) to monitor for full circulation to start the next drilling stroke.

I claim:

1. An extended reach drilling system for drilling a borehole in an underground formation, said extended reach drilling system comprising:

a) a drill bit;

b) a motor for driving the drill bit;

c) a drill-pipe to surface;

d) a hydraulic cylinder/piston arrangement for providing the required weight on the drill bit, the drill-pipe being coupled to a selected one of the cylinder and the piston of said cylinder/piston arrangement by swivel means allowing rotation of the drill pipe relative to said selected one of the cylinder and the piston, the drill bit being coupled to the other one of the cylinder and the piston, wherein the swivel means comprises a downhole clutch which is operable between a disengaged position in which rotation of the drill-pipe relative to said selected one of the cylinder and the piston is allowed, and an engaged position in which such relative rotation is prevented; and e) locking means for locking said selected one of the cylinder and the piston against the borehole wall, the locking means being operable between an engaged position and a disengaged position.

2. The extended reach drilling system of claim 1, wherein said selected one of the cylinder and piston is the cylinder, and said other one of the cylinder and piston is the piston.

3. The extended reach drilling system of claim 2, wherein said locking means comprises at least two sets of radially extendible locking members, the sets including a front set of locking members being provided at a front part (at the bit side) of the cylinder and a rear set of locking members being provided at a rear part (at the drill-pipe side) of the cylinder.

4. The extended reach drilling system of claim 3, wherein the locking members of at least one of the front set and the rear set of locking members are capable of positioning the cylinder concentric or eccentric in the borehole.

5. The extended reach drilling system of claim 4, wherein the front set of locking members is capable of positioning said front part of the cylinder concentric or eccentric in the borehole, and the rear set of locking members is capable of positioning said rear part of the cylinder concentric or eccentric in the borehole.

6. The extended reach drilling system of claim 1, further comprising a hydraulic pump for providing the power to operate the hydraulic cylinder/piston arrangement for the drilling action and each locking member for the wall locking action, the hydraulic pump being driven by rotation of the drill-pipe.

7. The extended reach drilling system of claim 6, wherein the motor for driving the drill bit is a hydraulic motor being driven by the oil from the hydraulic pump.

8. The extended reach drilling system of claim 1, wherein the axial stroke of the cylinder/piston arrangement is in the range of 1–5 meters.

9. The extended reach drilling system of claim 1, further comprising inclinometers and magnetometers for carrying out directional measurements, being sent to surface via telemetry.

10. The extended reach drilling system of claim 1, further comprising a memory to be entered by a pre-programmed well-path.

11. A method of starting a drilling stroke using the extended reach drilling system according to claim 1, the method comprising the following steps:

a) circulating mud at a reduced rate, the locking means being in its disengaged position, the piston of the cylinder/piston arrangement being in its retracted position, and the drill-pipe rotating relative to the cylinder/piston arrangement;

b) starting full rate mud circulation, triggering downhole electronics to start the drilling process as follows:

c) disengaging the downhole clutch;

d) engaging the locking means, thereby locking said selected one of the cylinder and the piston against the borehole wall;

e) actuating the cylinder/piston arrangement by which the drilling process is started.

12. A method of ending a drilling stroke using the extended reach drilling system according to claim 1, comprising the following steps:

a) retracting the axial piston;

b) disengaging the locking means;

c) engaging the downhole clutch so that the drilling system is rotating;

d) sending a pressure pulse to the surface to trigger the surface process;

e) lowering the rotating string by a top-drive according to the piston stroke;

f) reducing mud circulation as a signal for the downhole electronics to monitor for full circulation to start the next drilling stroke.

* * * * *